US006308461B1

(12) United States Patent
Hopson et al.

(10) Patent No.: US 6,308,461 B1
(45) Date of Patent: Oct. 30, 2001

(54) METHOD AND SYSTEM FOR DETECTING AN OBJECT IN THE PATH OF AN AUTOMOTIVE WINDOW UTILIZING A PIEZOELECTRIC SENSOR

(75) Inventors: Charles Hopson, Lebanon; Timothy Davies, Hermitage, both of TN (US); Christos Kyrtsos, Southfield; Joseph Tyckowski, Clawson, both of MI (US); Pascal Bonduel, Bouzy la Foret; Francois Breynaert, Caen, both of (FR)

(73) Assignee: Meritor Light Vehicle Systems, Inc., Troy, MI (US)

( * ) Notice: Subject to any disclaimer, the term of this patent is extended or adjusted under 35 U.S.C. 154(b) by 0 days.

(21) Appl. No.: 09/391,924

(22) Filed: Sep. 8, 1999

(Under 37 CFR 1.47)

(51) Int. Cl.[7] ..... E05F 15/02
(52) U.S. Cl. ..... 49/28; 318/280
(58) Field of Search ..... 49/26, 27, 28; 318/256, 257, 266–268, 280–286; 340/438, 545

(56) References Cited

U.S. PATENT DOCUMENTS

| | | | | |
|---|---|---|---|---|
| 4,328,540 | * | 5/1982 | Matsuoka et al. | 364/167 |
| 4,621,223 | * | 11/1986 | Murakami et al. | 318/282 |
| 5,459,379 | * | 10/1995 | Takeda et al. | 318/469 |
| 5,616,997 | * | 4/1997 | Jackson et al. | 318/467 |
| 5,754,017 | * | 5/1998 | Tsuge et al. | 318/286 |
| 5,774,046 | * | 6/1998 | Ishihara et al. | 340/438 |
| 5,932,931 | * | 8/1999 | Tanaka et al. | 307/10.1 |
| 5,977,732 | * | 11/1999 | Matsumoto | 318/283 |
| 5,996,071 | * | 10/1999 | Tsuge et al. | 340/438 |

* cited by examiner

*Primary Examiner*—Curtis A. Cohen
(74) *Attorney, Agent, or Firm*—Carlson, Gaskey & Olds

(57) ABSTRACT

A method and system for detecting the presence of an object caught between an automotive window and its respective frame is provided. The window opens and closes via a regulator driven by an electric drive motor. A force is sensed at an interface between the window and the regulator proportional to a force exerted on the window. This force is compared with a predetermined value, and if the sensed force exceeds the predetermined value, an object caught between the window and its respective door frame is detected.

12 Claims, 1 Drawing Sheet

METHOD AND SYSTEM FOR DETECTING AN OBJECT IN THE PATH OF AN AUTOMOTIVE WINDOW UTILIZING A PIEZOELECTRIC SENSOR

BACKGROUND OF THE INVENTION

This invention relates to a method and system for detecting an object caught in the path of an automotive window.

Many of the automotive vehicles today have electronically controlled windows and may even have electronically controlled sun/moon roofs. These systems provide the operator with ease in opening and closing the windows. However, if the operator is distracted while closing the window, it is possible for an object, such as an arm, hand or finger, to be caught between the window and the header, or seal, of the automotive window.

Techniques exist today to sense/detect the presence of objects when the window is closed against its seal. These techniques indirectly detect an object by measuring such variables as current and voltage of the motor driving the closure of the window. As these variables decrease or increase compared to the normal operating variables, an object is assumed to be present. However, other circumstances may affect these variables, such as temperature and reliability of the motor.

Thus, there exists a need to directly sense the presence of objects caught between a window and its respective seal, which is not dependent on other circumstances.

SUMMARY OF THE INVENTION

An object caught between a closing automotive window and its respective seal is directly detected by sensing a force at an interface between the window and a regulator that drives the window. The interface force is proportional to a force exerted on the window. This sensed force is converted into a proportional voltage value and compared with a predetermined value. If the sensed value exceeds the predetermined value, then an object between the window and its respective door frame is detected.

A control circuit that controls a drive motor coupled to the regulator can then stop the motor or reverse its direction so that the window opens, rather than closes. Thus, the object will not be trapped.

These and other features of the present invention can be understood from the following specification and drawings.

DETAILED DESCRIPTION OF A PREFERRED EMBODIMENT

Figure 1:
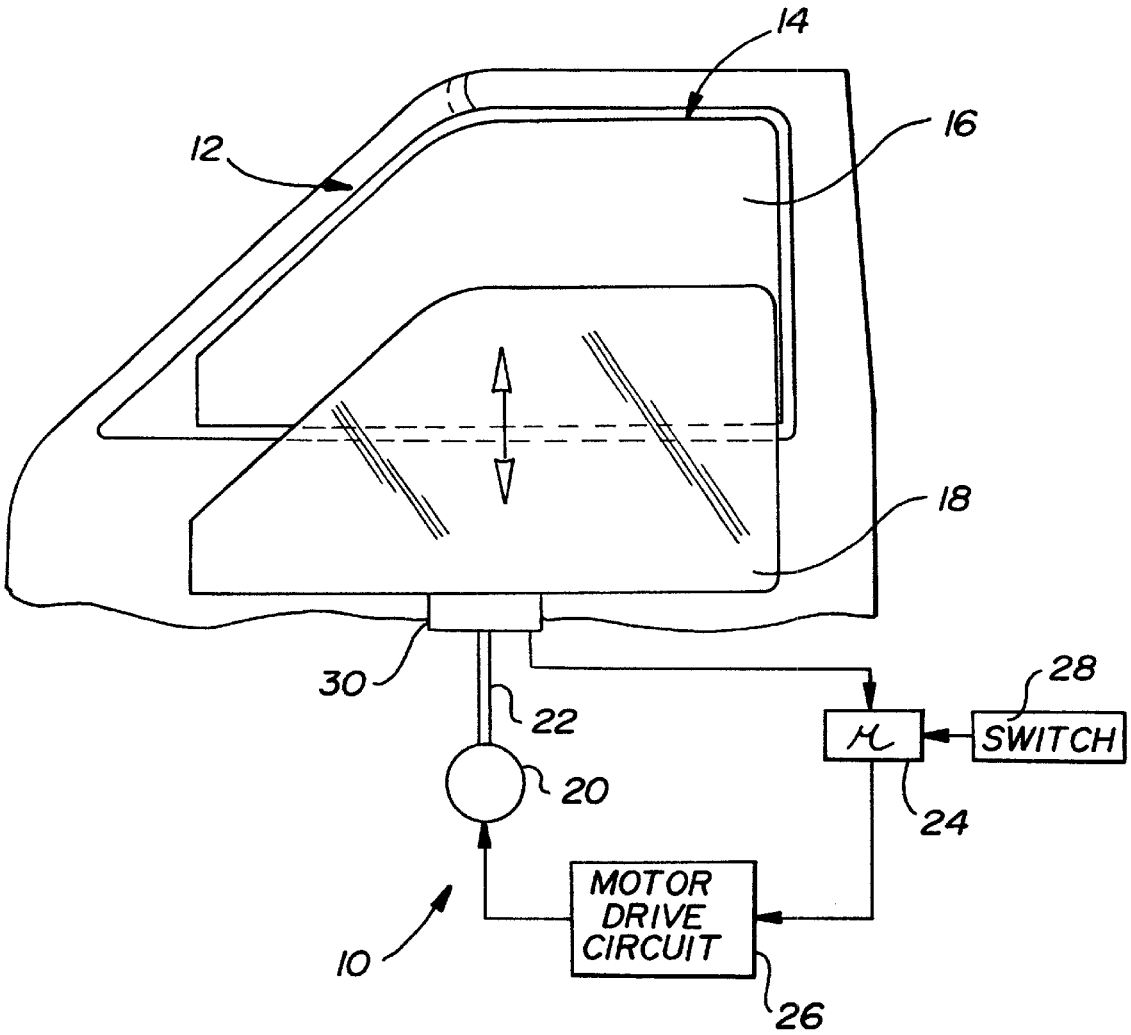
FIG. 1 is a schematic block diagram illustrating the power window system of the present invention.

FIG. 1 shows a power window system 10 incorporating the present invention. An automotive vehicle has a door 12 and a window frame 14 defining a window opening 16. While a side window is shown, the term "window" as used in this application also extends to rear windows, moon roofs, sun roofs or other vehicle closure components.

The door 12 is equipped with a window glass 18 movable elevationally within the window opening 16 and a drive motor 20 linked with a regulator 22, shown schematically, for driving the window glass 18 upward and downward. Microprocessor, or control circuit, 24 controls the drive motor 20 via motor drive circuit 26 in response to signals from switch 28 that commands upward/downward movement of the window glass 18.

Typically, the speed of the motor 20 is sensed to identify erratic behavior indicative of an extraneous force being exerted on the window glass 18, such as an arm, finger, etc. The present invention, however, senses a force being directly exerted on the window glass 18 as it is being driven upward. This is accomplished by positioning a sensor 30 between window glass 18 and drive motor 20 that generates a signal having a value proportional to the resistive force being applied to the window glass 18. The sensor 30 may be a piezoelectric sensor that senses a compressive pressure corresponding to the resistive force and then generates a proportional voltage signal for receipt by control circuit 24. The present invention is not limited to piezoelectric sensors as any sensors which generate signals proportional to force being applied may be used.

An obstruction between the window glass 18 and the window frame 14 increases the window resistance and thus an increasing pressure is sensed thereby resulting in an increasing voltage being sensed by control circuit 24. In response to detecting this obstruction, the control circuit 24 may then stop or reverse the motor voltage so as to stop or reverse the drive motor 20, respectively.

The present invention, thus, provides a more accurate and quicker detection and reaction to obstruction by sensing a force against the window glass 18 directly rather than indirectly through moving components.

Preferred embodiments have been disclosed. However, a worker in this art would recognize that modifications would come within the scope of this invention. Thus, the following claims should be studied to determine the scope and content of this invention.

What is claimed is:

1. A method for detecting the presence of an object caught between an automotive window and its respective frame, the window opening and closing via a regulator driven by an electric drive motor, the method comprising:

providing a sensor at a interface position between the window and the regulator;

said sensor sensing a force at said interface between the window and the regulator proportional to a force exerted on the window and sending a signal to a control circuit which the force with a predetermined value; and detecting an object between the window and its respective frame if the force exceeds the predetermined value.

2. The method as recited in claim 1 wherein comparing the force comprises determining a voltage value proportional to the amount of force sensed.

3. The method as recited in claim 1 further comprising controlling the motor in response to detecting the object.

4. The method as recited in claim 3 wherein controlling the motor comprises stopping the motor.

5. The method as recited in claim 3 wherein controlling the motor comprises reversing direction of the motor so that the window opens.

6. The method as recited in claim 1 wherein said window is a side window mounted in a door frame.

7. A window and a system for detecting the presence of an object caught between said window and its respective frame, the window opening and closing via a regulator driven by an electric drive motor, the system comprising:

a sensor mechanically coupled between the window and the regulator driven by an electric drive motor for moving said window, said sensor for sensing a force proportional to a force exerted on said window; and a control circuit connected to the sensor and to the motor for comparing the sensed force with a predetermined value and detecting an object between said window and frame if the force exceeds the predetermined value.

8. The system as recited in claim 7 wherein said sensor is further operative to determine a voltage value proportional to the amount of force sensed.

9. The system as recited in claim 8 wherein the sensor is a piezoelectric sensor.

10. The system as recited in claim 7 wherein the control circuit is further operative to control said motor in response to detecting the object.

11. The system as recited in claim 10 wherein the control circuit, in controlling said motor, is further operative to stop said motor.

12. The system as recited in claim 11 wherein the control circuit, in controlling said motor, is further operative to reverse direction of said motor so that said window opens.

* * * * *